US009206568B2

(12) United States Patent
Distefanis, Jr.

(10) Patent No.: US 9,206,568 B2
(45) Date of Patent: Dec. 8, 2015

(54) HEIGHT ADJUSTABLE SNOW BLOWER SHROUD

(71) Applicant: James Distefanis, Jr., Canton, MI (US)

(72) Inventor: James Distefanis, Jr., Canton, MI (US)

( * ) Notice: Subject to any disclaimer, the term of this patent is extended or adjusted under 35 U.S.C. 154(b) by 0 days.

(21) Appl. No.: 14/190,699

(22) Filed: Feb. 26, 2014

(65) Prior Publication Data

US 2014/0250739 A1 Sep. 11, 2014

Related U.S. Application Data

(60) Provisional application No. 61/773,481, filed on Mar. 6, 2013.

(51) Int. Cl.
*E01H 5/04* (2006.01)

(52) U.S. Cl.
CPC ..... *E01H 5/045* (2013.01); *E01H 5/04* (2013.01); *Y10T 16/184* (2015.01)

(58) Field of Classification Search
CPC ..... E01H 5/045; A01D 34/74; A01D 34/81
USPC ..... 37/241, 242, 243, 244, 248, 271; 56/320.1
See application file for complete search history.

(56) References Cited

U.S. PATENT DOCUMENTS

| | | | | | |
|---|---|---|---|---|---|
| 2,776,844 | A * | 1/1957 | Wilkin | 280/43.2 |
| 2,836,430 | A * | 5/1958 | Langenbacher | 280/43 |
| 2,909,884 | A * | 10/1959 | Knarzer | 56/320.1 |
| 3,269,100 | A * | 8/1966 | Smith | 56/17.2 |
| 3,468,041 | A * | 9/1969 | Mattson et al. | 37/246 |
| 3,927,513 | A * | 12/1975 | Ramaker et al. | 56/320.1 |
| 4,104,812 | A * | 8/1978 | Stribiak, Jr. | 37/243 |
| 4,172,351 | A * | 10/1979 | Scanland | 56/320.1 |
| 4,280,319 | A * | 7/1981 | Scanland | 56/255 |
| 4,756,101 | A * | 7/1988 | Friberg et al. | 37/244 |
| 4,942,726 | A * | 7/1990 | Bowditch | 56/17.2 |
| 5,259,175 | A * | 11/1993 | Schmidt | 56/17.2 |
| 5,638,667 | A * | 6/1997 | Ellson et al. | 56/320.1 |
| 5,638,668 | A * | 6/1997 | Kallevig et al. | 56/320.1 |
| 5,749,209 | A * | 5/1998 | Thomason | 56/17.2 |
| 6,490,851 | B2 * | 12/2002 | Kutsukake | 56/320.1 |
| 6,516,598 | B1 * | 2/2003 | Notaras et al. | 56/16.7 |
| 6,899,345 | B1 | 5/2005 | Bearden | |
| 7,347,013 | B2 * | 3/2008 | Deschler et al. | 37/260 |
| 8,069,639 | B2 * | 12/2011 | Fancher, III | 56/17.2 |
| D657,395 | S | 4/2012 | Bauer et al. | |
| 8,191,289 | B2 | 6/2012 | Raftery | |
| 2005/0066553 | A1 | 3/2005 | Light | |
| 2008/0189990 | A1 | 8/2008 | Luhtanen et al. | |

* cited by examiner

*Primary Examiner* — Jamie L McGowan
(74) *Attorney, Agent, or Firm* — Daniel Boudwin; Global Intellectual Property Agency LLC

(57) ABSTRACT

A height adjustable auger shroud for a snow blower comprises a pair of wheels secured to a lower portion of the opposing sides of the shroud. The wheels are secured to the shroud by a pair of levers. Each lever comprises a first and second plate. The first plate is positioned against the shroud, and includes an upper arcuate perimeter having a series of notches along the upper perimeter line. The second plate is rotatably connected to the first plate, and includes a lever arm on one vertical half of the plate, and a wheel attachment on the opposing half of the plate. Actuation of the lever arm in relation to the first plate raises or lowers the wheel in relation to the shroud, thereby altering the distance between the shroud and the ground surface.

9 Claims, 4 Drawing Sheets

HEIGHT ADJUSTABLE SNOW BLOWER SHROUD

CROSS REFERENCE TO RELATED APPLICATION

Figure 1:
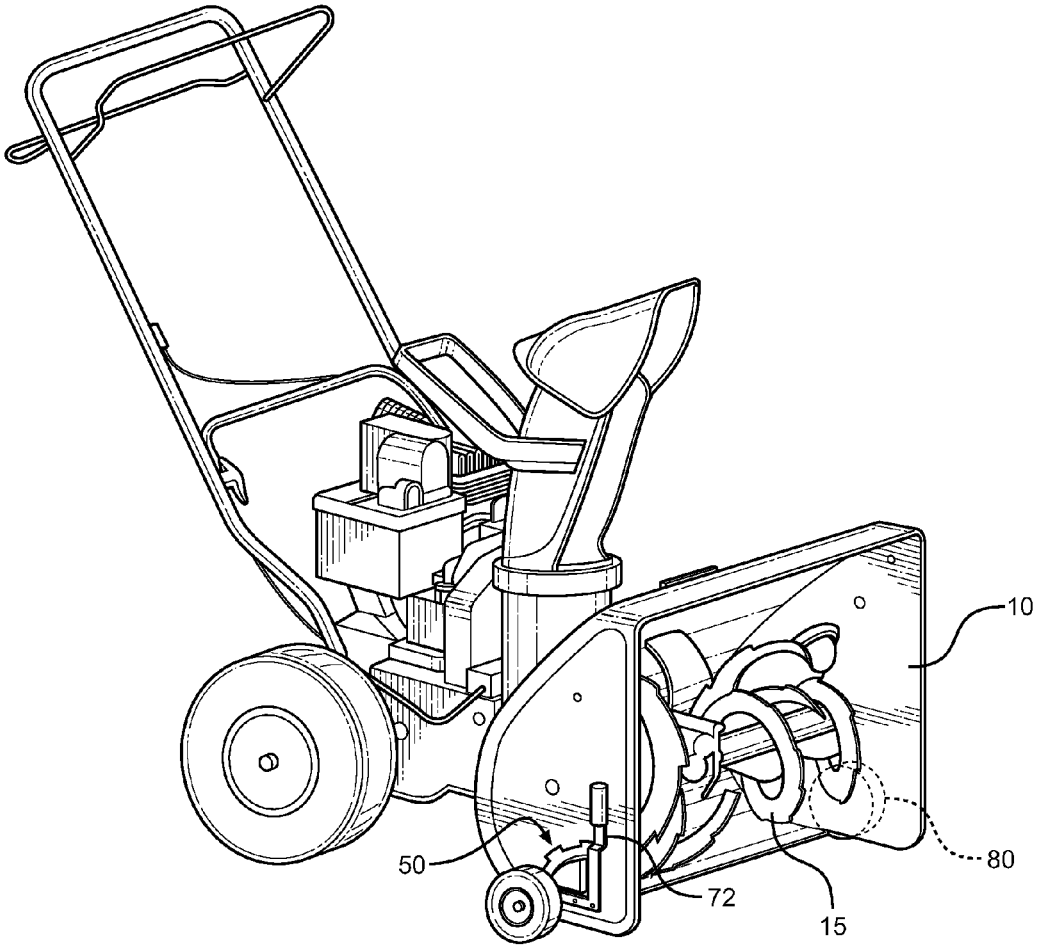

This application claims the benefit of U.S. Provisional Application No. 61/773,481 filed on Mar. 6, 2013, entitled "Snow Blower Roller". The above identified patent application is herein incorporated by reference in its entirety to provide continuity of disclosure.

BACKGROUND OF THE INVENTION

1. Field of the Invention

The present invention relates to a snow blower. More specifically the invention relates to a snow blower that comprises wheels that are configured to adjust the height of the snow blower's auger shroud.

A snow blower is a device that is utilized for removing snow from a ground surface. The device includes a motorized unit, an auger, an auger shroud, skid shoes, and a chute for deflecting snow. During use, a user will walk or ride on the snow blower along a chosen path. The skid shoe provides a separation between the ground and the bottom of the auger shroud, thereby enabling auger to contact snow without contacting the ground. The snow enters the shroud and the auger sends the snow up the chute and is thrown in a desired direction. Continued use of the machine eventually clears a pathway and redistributes the snow in an area away from the pathway.

While the traditional snow blower is useful for its own purposes, the design has a few drawbacks. First, the use of skid shoes are only appropriate for contact with smooth surfaces, such as snow. The skid shoe is not capable of rotating during contact with a ground surface, and therefore the skid shoe causes excess friction against all other terrain. A user manipulating a user-pushed snow blower must lift the front end of a snow blower to avoid scratching or wearing down the skid shoe. Continued use on these surfaces would lead to the replacement of the skid shoes. After an area is cleared of snow the remaining surface would be absent of snow, which would lead to contact with an undesirable surface.

A second drawback of the traditional snow blower design is that the skid shoes lack height adjustment mechanisms. If, for example, a user wishes to clear a greater or lesser amount of snow, there are no readily available options to adjust the height of the auger shroud in relation to a ground surface. While the height of the shroud may be efficient for traveling over flat surfaces, the auger may contact grass, rocks, or foreign devices if the shroud is not raised.

Devices are known that attempt to remedy some of the setbacks of the design of a traditional snow blower. Some devices offer the attachment of wheels that enable a snow blower to traverse differing ground surfaces. Other devices provide height adjustment mechanisms. There are no snow blowers, however, that combine a wheel with a user friendly height adjustment mechanism.

The present invention, however, provides a height adjustable auger shroud for use with a snow blower. The shroud comprises a pair of wheels that enable a user to easily traverse varying terrains without worrying that comes with the wearing down of skid shoes. Additionally, the shroud comprises a height adjustable lever that facilitates the quick adjustment of the shroud height with a movement of the lever. The assembly mounts a skid shoe location on a traditional auger shroud and allows for a simple, durable, and height adjustable assembly that will not have to be frequently replaced. The assembly provides seamless operation between flat to uneven or gravel surfaces. It is submitted that the present invention saves time, money, and exposure to the cold elements that may otherwise occur with traditional auger operation without deploying the present invention.

2. Description of the Prior Art

Devices have been disclosed in the prior art that relate to snow blower auger shroud attachments. These include devices that have been patented and published in patent application publications. These devices generally relate to wheel and height adjustment attachments on an auger shroud. The following is a list of devices deemed most relevant to the present disclosure, which are herein described for the purposes of highlighting and differentiating the unique aspects of the present invention, and further highlighting the drawbacks existing in the prior art.

One such prior art device, U.S. Patent Publication No. 2005/0066553 to Light provides a snow blower with wheels that are configured to maintain an auger housing at a fixed distance from the ground. The wheels may be fixably secured to the side walls of the auger housing and may be secured at a chosen height on the housing. The prior art device, however, secures the wheel directly to the side of the auger housing, thereby requiring a separate securing aperture along the housing for each desired height adjustment. The prior art differs from the present invention in that it fails to provide an adjustable lever to readily adjust the distance between the auger shroud and the ground surface.

Another prior art device, U.S. Pat. No. 6,899,345 to Bearden, provides a lawn mower with a height adjustable wheel assembly. The adjustable assembly may replace either the front or rear wheels of the lawn mower. The assembly may have a mounting plate with a plurality of apertures. A pin or other securing device may be inserted through the apertures to secure the wheel at a desired height. The use of the assembly, however, requires an extension away from the housing, and further provides an opportunity to misplace, or provide for the loosening of the securing pin.

U.S. Patent Publication No. 2008/0189990 to Luhtanen provides a wheel attachment for an auger shroud housing. The wheels are made of a rigid material configured for cutting through ice and snow, whereafter the wheel may rotate on a hard surface. Additionally, the wheels may be vertically adjustable to regulate the distance between the hard surface and the cutting edge of the rotatable wheel. While the height adjustable wheel of the prior art is useful for its own purposes, the devices provides vertical adjustment by providing a plurality of vertical holes that each must be bolted separately to provide the height adjustment. The present invention, however, provides a singular attachment lever that may be easily moved to facilitate a change in distance between a ground surface and the auger shroud.

Another prior art device, U.S. Pat. No. 8,191,289 to Raftery provides a skid shoe for a snow blower. The skid is secured to the vertical side of an auger housing. The skid comprises a sliding surface adapted for traversing snow covered areas, and a rolling surface configured for traveling over a variety of terrain. The prior art device of Raftery, however, fails to provide a height adjustable wheel that is configured to prevent unwanted contact between the auger shroud and a ground surface.

Finally, U.S. Design Pat. No. D657,395 to Bauer provides a design for a wheel attachment for a snow blower. The design illustrates a horizontal plate with a plurality of holes configured for the bolting of a wheel thereon. The design, however, merely illustrates the attachment of a wheel and fails to illustrate the use of a lever for adjusting the height of an auger shroud in relation to a ground surface.

The present invention however, differs from the prior art in that the present invention is provides a user-friendly and convenient way to facilitate the changing the height of an auger shroud. Moreover, the present invention replaces the traditional skid shoe with a rotatable wheel. The present invention provides a user with a device that allows from easy transitions between ground surfaces and eliminates the need for constant replacing of worn down skid shoes.

It is submitted that the present invention substantially diverges in design elements from the prior art, and consequently it is clear that there is a need in the art for an improvement to existing snow blower auger shroud attachment devices. In this regard the instant invention substantially fulfills these needs.

SUMMARY OF THE INVENTION

In view of the foregoing disadvantages inherent in the known types of auger shroud attachments now present in the prior art, the present invention provides a new attachment wherein the same can be utilized for providing convenience for the user when traversing over differing terrain and adjustability of the auger shroud height is desired.

It is therefore an object of the present invention to provide a new and improved auger shroud attachment device that has all of the advantages of the prior art and none of the disadvantages.

It is another object of the present invention to provide an auger shroud having rotatable wheels.

Another object of the present invention is to provide an auger shroud having a height adjusting lever.

Yet another object of the present invention is to provide an auger shroud configured for adjustment over differing ground surfaces.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1 displays a view of the height adjustable shroud of the present invention.

Figure 2:
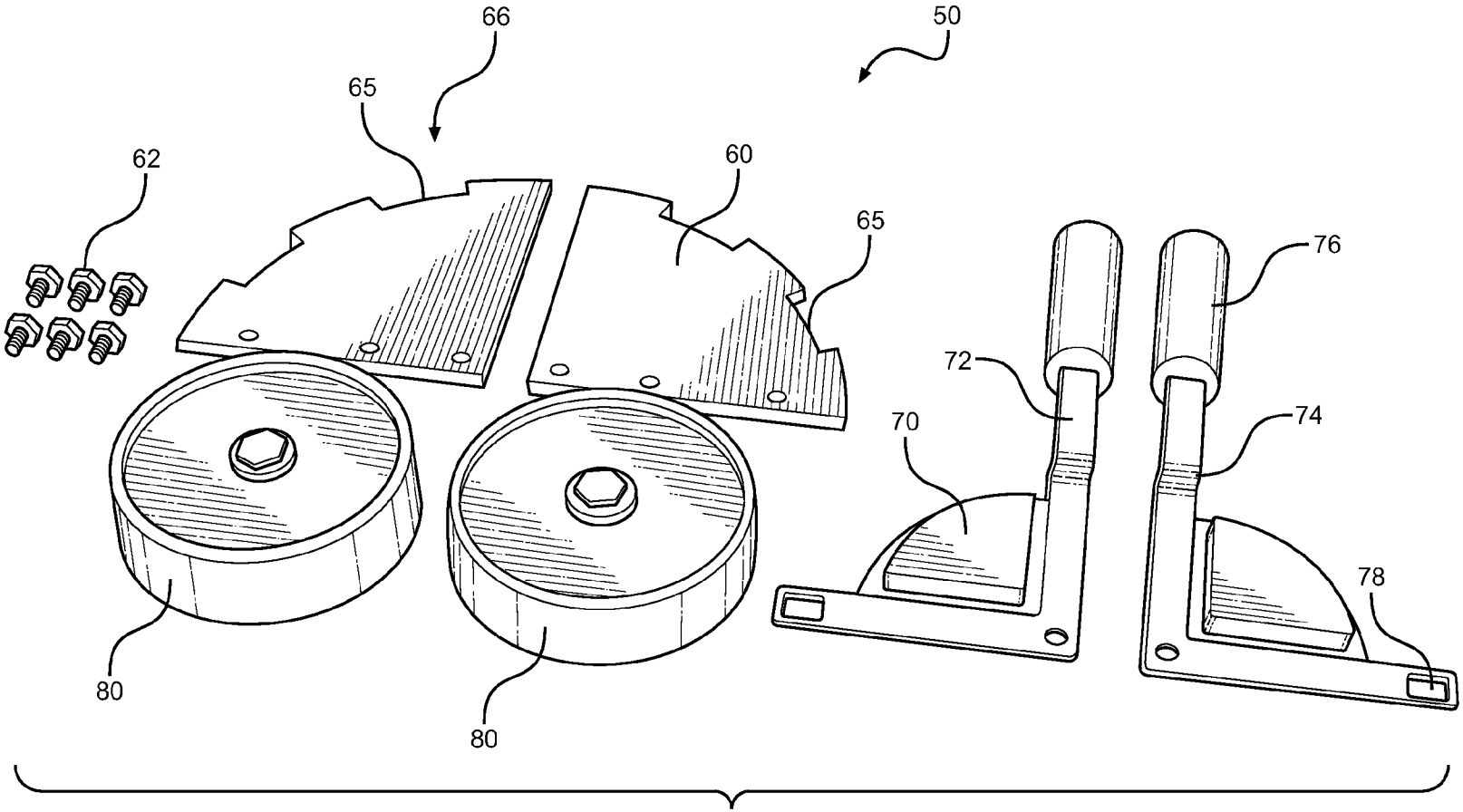

FIG. 2 displays a view of the lever and wheels of the height adjustable shroud of the present invention.

Figure 3:
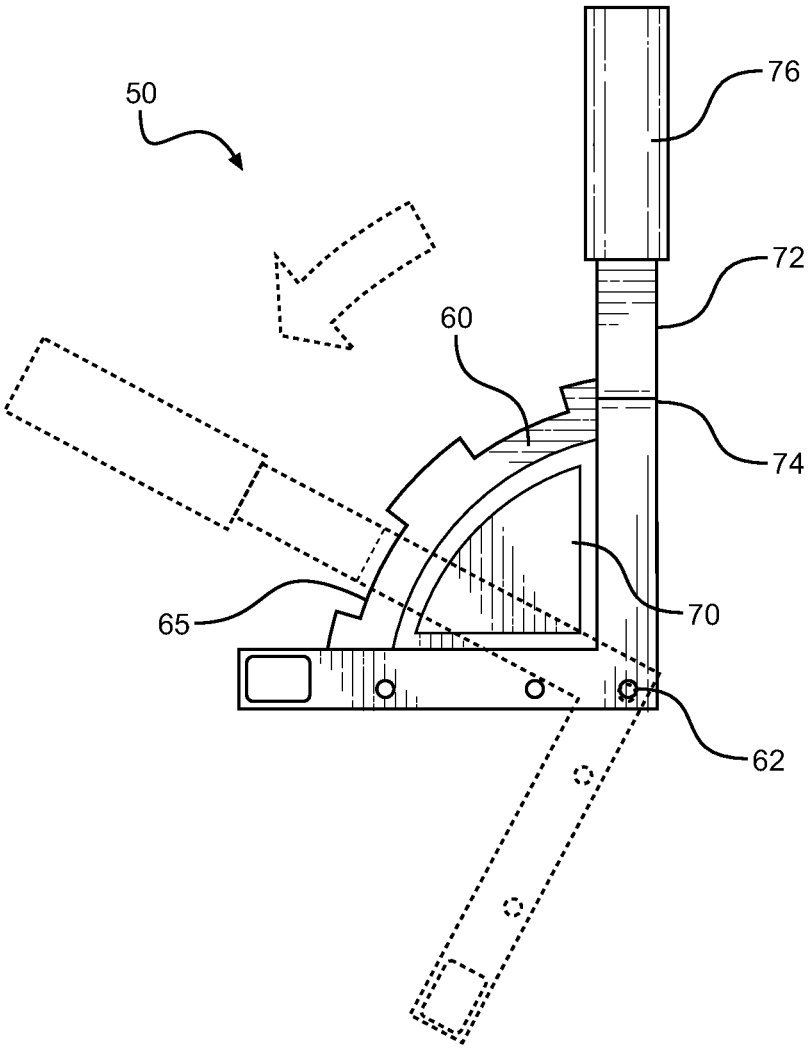

FIG. 3 displays a close-up view of the height adjusting lever of the present invention.

Figure 4A:
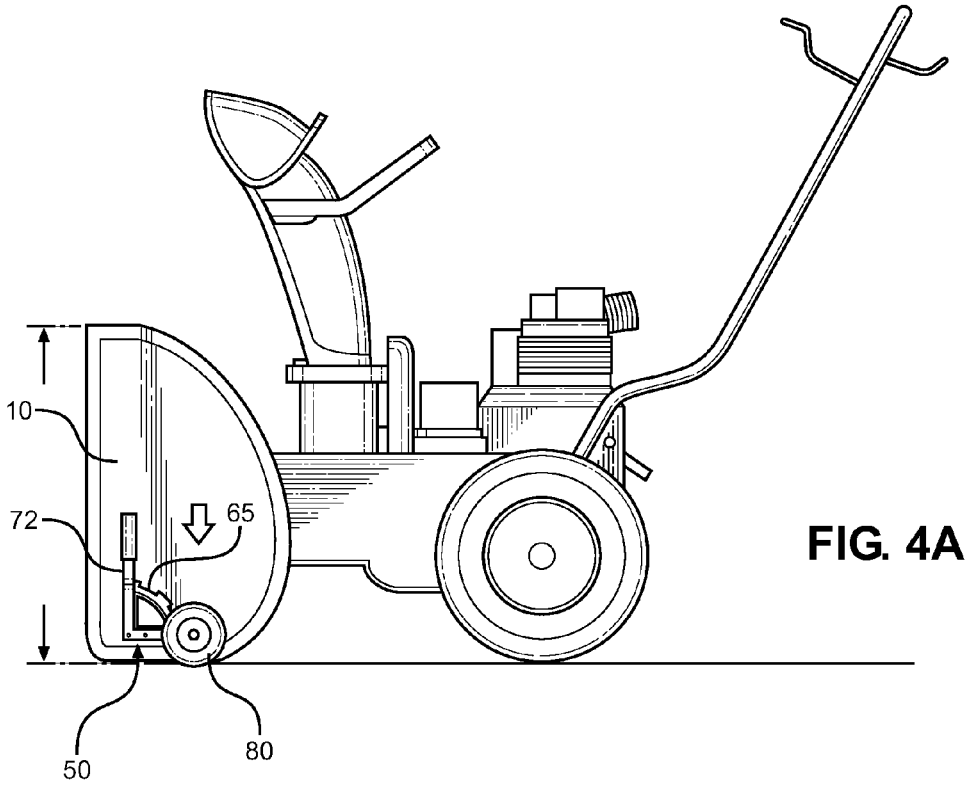
Figure 4B:
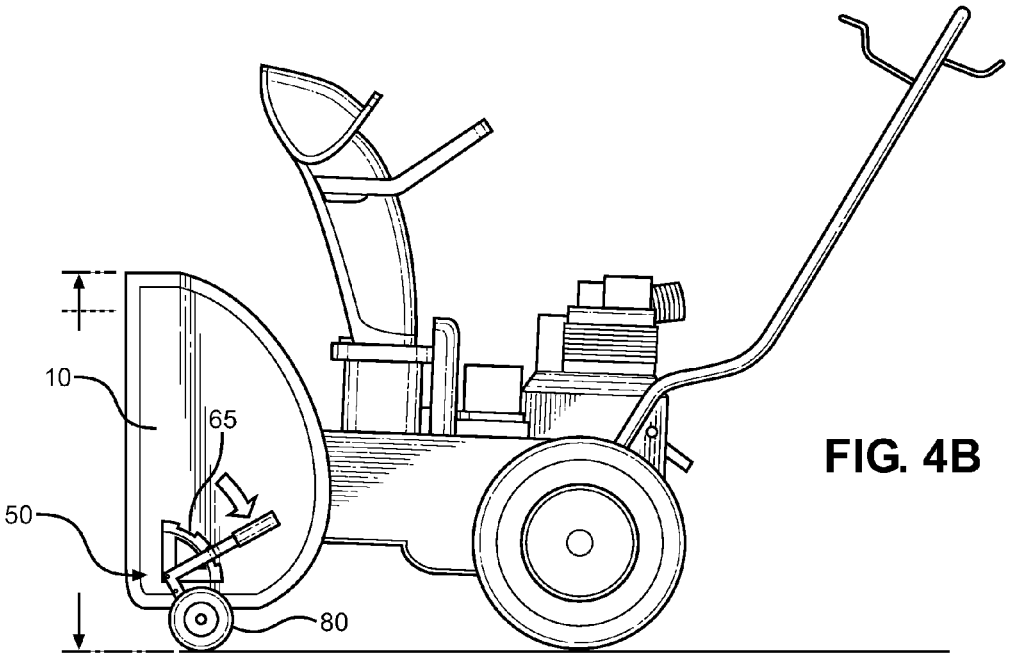

FIGS. 4A and 4B display views of the height adjusting lever during use.

DETAILED DESCRIPTION OF THE INVENTION

Reference is made herein to the attached drawings. Like reference numerals are used throughout the drawings to depict like or similar elements of the adjustable auger shroud. For the purposes of presenting a brief and clear description of the present invention, the preferred embodiment will be discussed as used for adjusting the height of the shroud to enable use on different surfaces. The figures are intended for representative purposes only and should not be considered to be limiting in any respect.

FIG. 1 displays a view of a snow blower with the height adjustable auger shroud of the present invention. The adjustable auger shroud comprises a shroud housing 10, an auger 15, and wheels 80 attached to the exterior auger housing 10, whereas traditional snow blowers have snow skids. The wheels 80 may be comprised of a rubber, hard plastic, or other suitable material that is adapted for use over a variety of terrain. Examples of terrain include that of snow-covered, gravel, grass, or paved surfaces. Moreover, the wheels 80 may comprise a tread that enables the gripping of the wheel on the ground surface. The wheels 80 are secured onto opposing sides of the adjustable shroud housing 10 by a pair of levers 50. Actuation of the arm 72 of the lever 50 in a forward or reversed direction facilitates movement of the wheels 80 in relation to the auger shroud housing 10, thereby facilitating the lifting and lowering of the auger shroud 10 in relation to the ground surface.

Referring now to FIG. 2, there is shown a close-up view of the height adjusting levers 50. The lever 50 is comprised of a pair of first 60 and second 70 connected plates, and a lever arm 72. The first plate 60 is configured for fastening directly against the bottom of a side of the shroud. The first plate 60 has an arcuate upper perimeter 66 with a series of notches 65 positioned within the edge of the upper perimeter 66 of the first plate 60.

The second plate 70 is rotatably fastened 62 near the bottom perimeter of the first plate 60 at a pivot point. The second plate 70 comprises a lever arm 72 in perpendicular relationship with a wheel support portion. The lever arm 72 and the wheel support portion extend from the second plate 70 and share the common fastener 62 that secures the first 60 and second plates together. The lever arm 72 includes a gripping portion 76 and a projection portion 74. The gripping portion 76 is located at a distal end of the lever arm 72, whereby the gripping portion 76 of the arm 72 lies beyond the arcuate perimeter 66 of the first plate 60 when the plates are secured together. A user is capable of grasping the gripping portion 76 of the lever arm 72 and moving the arm 72 and second plate 70 in relation to the stationary first plate 60. The wheel support portion comprises a member having an aperture 79 adapted to accept the roller wheel 80 rotatable connected thereto.

The lever projection portion 74 is positioned midway along the length of the lever arm 72. The projection 74 comprises an outward bend or curvature that aligns with each of the perimeter notches 65 of the first plate 60 when the lever arm 72 and second plate 70 are rotated in relation to the first plate 60. The insertion of the projection 74 into each of the separate insertion notches 65 corresponds to different height adjustments of the shroud in relation to the ground surface. In use, a user pulls back on the lever arm 72 to remove the projection 74 from the insertion notch 65 of the first plate 60. A user may then move the lever arm 72 to another position along the first plate 60 and insert the projection 74 into a different insertion notch 65, thereby raising or lowering the auger shroud.

A wheel 80 is secured to an aperture 78 on the second plate 70, whereby the aperture 78 is located at a position away from the lever arm 72. The wheel is configured to be rotatably secured within the aperture 72. Contact between the ground surface and the wheel 80 facilitates the rotation of the wheel, which enables a user to effortlessly move a snow blower through a variety of terrain. Different forms of terrain may require different distances between the shroud housing and a ground surface. FIG. 3 displays the movement of the lever arm 72 along the arched upper perimeter 66 of the first plate 60. Actuation of the lever arm 72 causes the wheel to follow the arched perimeter. The positioning differences of the lever arm 72 in relation to the first plate 60 raises or lowers the wheel 80 in relation the shroud, thereby enabling a user to easily traverse different terrain.

Referring now to FIGS. 4A and 4B, there are displayed views of the height adjustable auger shroud in use, whereby the placement of the lever arm 72 determines the distance between the shroud 10 and a ground surface. In FIG. 4A the lever arm 72 is substantially vertical and the wheel is disposed in a position relative to the shroud such that the shroud lower surface rests against the ground surface. Therefore, the lower extent of the wheel 80 at this position is equal in elevation relative to the shroud lower extent. A movement of the lever arm 72 in relation to the insertion notches 65 facilitates the raising or lowering of the auger shroud 10. The change in height may assist a user in traversing over different terrain. For example, a higher auger shroud positioning may enable a user to easily move across grass or gravel, whereas a lower auger shroud 10 position may aid a user in plowing through the snow.

FIG. 4B displays a view of the auger shroud. The wheels 80 are secured to one side of the second plate, whereas the lever arm 72 is positioned on an opposing side of the second plate. Movement of the lever arm 72, wheel 80, and the second plate relative to the first plate, causes each to follow an arcuate path. Each of the insertion notches 65 of the first plate correspond to a different vertical height difference between the auger shroud 10 and a ground surface. The wheel 80 moves up or down along the sides of the auger shroud 10 as the projection is inserted into different insertion notches 65, thereby providing a different distance between the wheel and the ground, and therefore a different height between the auger shroud 10 and the ground. The shroud will be sitting on the ground when the wheel 80 is in the lowered or lowest position such that the shroud can scrape concrete or hard flat surface clean without any gaps therebetween. The wheels 80 will have two more positions in which to elevate the shroud. The first elevated position is contemplated to raise the shroud approximately one inch from the ground to allow slightly uneven surfaces to pass thereunder without catching the shroud scrapper bar underneath, such as on an uneven sidewalk for example. A second notch position raises the shroud approximately two inches off the ground so the snow blower can safely operate over gravel driveways without drawing in debris, like rocks, that can damage the auger and prevent costly repairs. The exact height movement per notch engagement may change with a given design, along with the number of allowable locations in which a user can lock the shroud height. It is desired to disclose a new wheel and lever assembly that facilitates this functionality.

The present invention provides a replacement for traditional auger skid shoes, thereby enabling the transportation of a snow blower over different terrain. The replacement comprises a pair of wheels 80 that are secured 78 onto a height adjustable auger shroud 10. The wheels are attached to a lower portion of the opposing sides of the auger by a pair of plates. The first plate 60 comprises an arcuate upper perimeter 66 with a plurality of insertion notches 65 within the upper perimeter of the plate. The second plate 70 comprises a lever arm 72 and a wheel 50. The second plate 70 is movable relative to the first plate 60. The lever arm 72 comprises a projection 74 that is configured for insertion into the insertion notches 65 of the first plate 60. The wheel 50 follows the arcuate path of the lever arm 72 as the lever projection 74 is inserted into each notch 65 of the first plate 60. Each notch 65 of the arcuate path 66 corresponds to a different vertical height of the wheel 50 in relation to the first plate 60, thereby raising or lowering the distance between the shroud 10 and a ground surface. It is contemplated that a raised shroud housing 10 enables a user to easily traverse terrain, such as grass, dirt, and graveled surfaces. A lowered shroud housing 10 is configured to provide a closer proximity with the ground surface and the auger 15, thereby enabling a user to clear a pathway using a snow blower.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A height adjustable shroud configured for placement on a snow blower, said shroud comprising;

a shroud housing, and a pair of roller wheels attached to said housing;

whereby said roller wheels are connected to opposing sides of said shroud housing by a lever assembly, said lever assembly comprising:

a first plate and a second plate;

whereby said first and second plates are secured to said shroud housing by a fastener;

whereby said first plate is secured against said shroud and said second plate is secured to said first plate by the fastener securing said first and second plates onto said shroud housing;

said first plate comprising a plurality of upper perimeter insertion notches;

whereby said second plate is rotatably connected to said first plate, said second plate comprising a spacer that makes contact with said first plate;

said second plate further comprising a lever arm having a handle portion and a projection portion, and a wheel support portion rotatably supporting said roller wheel;

whereby said projection portion is insertable within said insertion notches of said first plate;

whereby said notches correspond to different shroud housing heights;

whereby said spacer prevents contact between said handle portion and said first plate;

whereby a movement of said lever assembly changes the distance between said shroud housing and a ground surface.

2. The height adjustable shroud of claim 1, whereby said first plate comprises an arcuate upper perimeter.

3. The height adjustable shroud of claim 1, whereby said lever arm moves said roller wheel along an arcuate path, thereby raising and lowering said roller wheel in relation to said shroud housing.

4. The height adjustable shroud of claim 1, whereby said projection portion comprises an outward bend that is adapted to align with each of the perimeter notches when positioned thereover.

5. The height adjustable shroud of claim 1, whereby said lever arm and said wheel support portion are in perpendicular relation to one another.

6. A wheel assembly adapted to be fastened onto the shroud housing of a snow blower, comprising:

a lever assembly comprising a first plate, a second plate, a lever arm, and a roller wheel;

said first plate adapted to be secured against a shroud housing and said second plate being rotatably connected to said first plate at a pivot point, whereby said second plate is secured to said first plate by the fastener securing said first and second plates onto said shroud housing;

said first plate comprising a plurality of upper perimeter insertion notches;

said second plate comprising a spacer that makes contact with said first plate, a lever arm having a handle portion and a projection portion, and a wheel support portion rotatably supporting said roller wheel;

whereby said projection portion is insertable within said insertion notches of said first plate;

whereby said notches correspond to different roller wheel positions relative to said pivot point;

wherein said spacer prevents contact between said handle portion and said first plate.

7. The wheel assembly of claim 6, whereby said first plate comprises an arcuate upper perimeter.

8. The wheel assembly of claim 6, whereby said lever arm moves said wheel along an arcuate path.

9. The wheel assembly of claim 6, whereby said projection portion comprises an outward bend that is adapted to align with each of the perimeter notches when positioned thereover.

* * * * *